US008816953B2

(12) United States Patent
Kim et al.

(10) Patent No.: US 8,816,953 B2
(45) Date of Patent: Aug. 26, 2014

(54) LIQUID CRYSTAL DISPLAY AND SCANNING BACK LIGHT DRIVING METHOD THEREOF

(75) Inventors: Jonghoon Kim, Seoul (KR); Bogun Seo, Gyeonggi-do (KR); Byungsam Min, Gyeonggi-do (KR); Hyunwoo Jeon, Gyeonggi-do (KR); Jonggu Heo, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 487 days.

(21) Appl. No.: 12/591,842

(22) Filed: Dec. 2, 2009

(65) Prior Publication Data

US 2011/0084987 A1 Apr. 14, 2011

(30) Foreign Application Priority Data

Oct. 8, 2009 (KR) ..... 10-2009-0095813

(51) Int. Cl.
*G09G 3/38* (2006.01)
*G09G 3/34* (2006.01)

(52) U.S. Cl.
CPC ..... *G09G 3/342* (2013.01); *G09G 2310/0237* (2013.01); *G09G 2320/064* (2013.01); *G09G 2310/024* (2013.01)
USPC ..... 345/102; 345/691

(58) Field of Classification Search
CPC ..... G09G 2310/0237; G09G 2310/024; G09G 2320/064; G09G 3/342; G09G 3/3426; G09G 3/2014; G09G 3/3406
USPC ..... 345/211–213, 102; 349/61–71; 315/291–311
See application file for complete search history.

(56) References Cited

U.S. PATENT DOCUMENTS

| | | | | |
|---|---|---|---|---|
| 6,445,143 | B1 * | 9/2002 | Min | 315/307 |
| 6,593,709 | B2 * | 7/2003 | Lee et al. | 315/302 |
| 6,812,916 | B2 * | 11/2004 | Hwang | 345/102 |
| 7,113,158 | B1 * | 9/2006 | Fujiwara et al. | 345/87 |
| 7,321,206 | B2 * | 1/2008 | Kang et al. | 315/291 |
| 7,323,832 | B2 * | 1/2008 | Fukumoto | 315/308 |
| 7,348,959 | B2 * | 3/2008 | Kim | 345/102 |
| 7,439,945 | B1 * | 10/2008 | Awalt et al. | 345/83 |
| 7,531,971 | B2 * | 5/2009 | Weng | 315/291 |
| 7,764,266 | B2 * | 7/2010 | Ho et al. | 345/102 |
| 7,781,979 | B2 * | 8/2010 | Lys | 315/185 S |
| 7,903,082 | B2 * | 3/2011 | Sakurai | 345/102 |

(Continued)

FOREIGN PATENT DOCUMENTS

| | | | |
|---|---|---|---|
| JP | 2006189806 | A | 7/2006 |
| KR | 20040107559 | A | 12/2004 |
| KR | 20080017280 | A | 2/2008 |

*Primary Examiner* — Vijay Shankar
*Assistant Examiner* — Sanjiv D Patel
(74) *Attorney, Agent, or Firm* — McKenna Long & Aldridge, LLP

(57) ABSTRACT

A liquid crystal display (LCD) device and method of the driving the same is disclosed. According to an embodiment of the present invention, an LCD device includes a liquid crystal display panel; a plurality of backlight sources configured to provide light to the liquid crystal display panel; a scanning backlight controller configured to generate a pulse width modulation (PWM) signal for controlling a turn-on time and a turn-off time of the light sources and a current control signal for controlling a driving current of the backlight light sources; and a plurality of light source drivers configured to turn on and off the backlight sources in response to the PWM signal and control the driving current of the backlight sources in response to the current control signal.

12 Claims, 5 Drawing Sheets

(56) References Cited

U.S. PATENT DOCUMENTS

| | | | | |
|---|---|---|---|---|
| 8,110,997 | B2 * | 2/2012 | Muramatsu | 315/185 R |
| 2005/0001801 | A1 * | 1/2005 | Kim | 345/89 |
| 2005/0007325 | A1 * | 1/2005 | Kim et al. | 345/87 |
| 2005/0104837 | A1 * | 5/2005 | Baik et al. | 345/99 |
| 2006/0158393 | A1 * | 7/2006 | Fukumoto et al. | 345/76 |
| 2007/0018919 | A1 * | 1/2007 | Zavracky et al. | 345/87 |
| 2007/0216636 | A1 * | 9/2007 | Lo | 345/102 |
| 2008/0001911 | A1 * | 1/2008 | Kim | 345/102 |
| 2008/0042953 | A1 * | 2/2008 | De Haan et al. | 345/89 |
| 2008/0042968 | A1 * | 2/2008 | Oh | 345/102 |
| 2008/0231621 | A1 * | 9/2008 | Chang et al. | 345/211 |
| 2008/0290933 | A1 * | 11/2008 | Thandi et al. | 327/541 |
| 2009/0091265 | A1 * | 4/2009 | Song et al. | 315/185 R |
| 2009/0091528 | A1 * | 4/2009 | Hong | 345/102 |

* cited by examiner

LIQUID CRYSTAL DISPLAY AND SCANNING BACK LIGHT DRIVING METHOD THEREOF

This application claims the benefit of Korean Patent Application No. 10-2009-0095813 filed on Oct. 8, 2009, which is hereby incorporated by reference for all purposes as if fully set forth herein.

BACKGROUND

1. Field of the Invention

The present invention relates to a liquid crystal display (LCD) device, and more particularly, to an LCD device and method of driving a scanning backlight thereof.

2. Discussion of the Related Art

Liquid crystal display (LCD) devices are now commonly used in a wide variety of applications because of their characteristics, such as lightweight, thinness, and low power consumption. LCD devices are being used for office automation devices, audio/video devices, indoor/outdoor advertising display devices, and portable computers such as notebook computers. Typical transmission-type LCD devices display images by modulating light incident from a backlight by controlling an electric field applied to a liquid crystal layer.

A viewer may notice blurring of moving images due to a retention characteristic of liquid crystal when moving images are displayed on an LCD device. A scanning backlight driving technology may reduce the blurring of moving images by providing a similar effect as an impulsive driving method used in cathode ray tubes (CRTs) in such a way as to sequentially turn on and off the light sources of the backlight in the scanning direction of the display lines.

The scanning backlight driving technology is, however, disadvantageous in that the screen becomes darker because the light sources of the backlight are turned off for a certain period of time during every frame interval. In order to solve this problem, a method of controlling the turn-off time according to the brightness or luminance of an LCD device may be considered. In such a case, the turn-off time is shortened or the turn-off time does not exist in bright screens, which counters the improvement on blurring phenomenon of the scanning backlight driving technology.

SUMMARY OF THE INVENTION

Accordingly, the present invention is directed to a liquid crystal display (LCD) device and method of driving a scanning backlight thereof that substantially obviates one or more of the problems due to limitations and disadvantages of the related art.

An advantage of the present invention is to provide an LCD device and method of driving a scanning backlight thereof that is capable of reducing a motion blur phenomenon with minimized reduction in the brightness or luminance of the LCD device caused by the scanning backlight driving.

Additional features and advantages of the invention will be set forth in the description which follows, and in part will be apparent from the description, or may be learned by practice of the invention. This and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display (LCD) device may, for example, include a liquid crystal display panel; a plurality of backlight sources configured to provide light to the liquid crystal display panel; a scanning backlight controller configured to generate a pulse width modulation (PWM) signal for controlling a turn-on time and a turn-off time of the light sources and a current control signal for controlling a driving current of the backlight light sources; and a plurality of light source drivers configured to turn on and off the backlight sources in response to the PWM signal and control the driving current of the backlight sources in response to the current control signal.

In another aspect of the present invention, a scanning backlight driving method for a liquid crystal display (LCD) device may, for example, include analyzing an input video signal; generating a pulse width modulation (PWM) signal to control a turn-on time of a backlight source based on a result of the analyzing an input video signal; and adjusting a driving current of the backlight source in an inverse proportion to a duty ratio of the PWM signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings. The same reference numbers may be used throughout the drawings to refer to the same or like parts.

An embodiment of the present invention is described below with reference to FIGS. 1 to 7.

Figure 1:
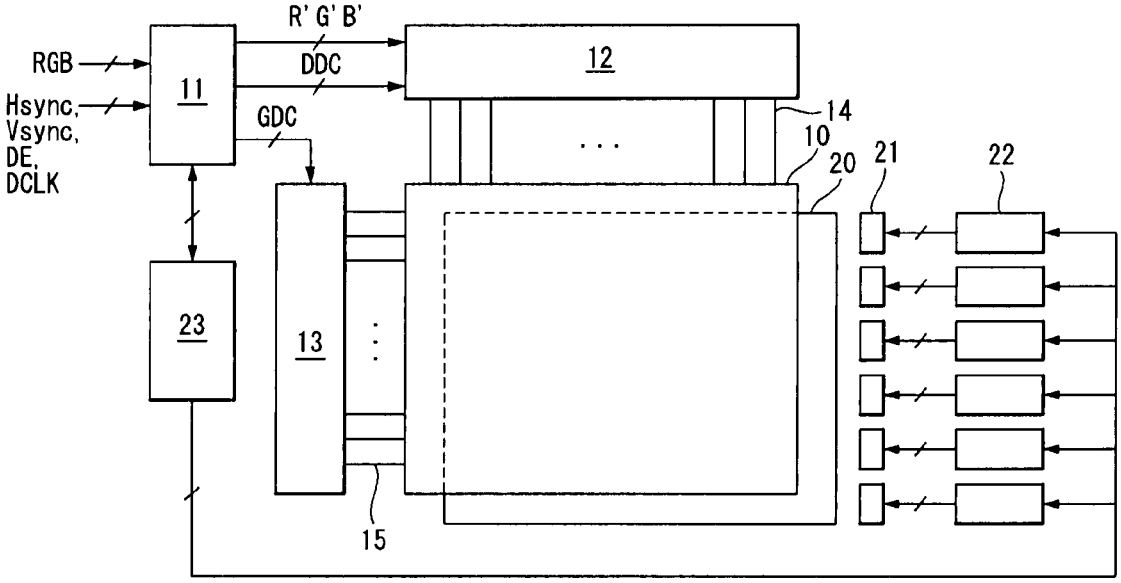
FIG. 1 is a block diagram of a liquid crystal display (LCD) device according to an embodiment of the present invention.
Figure 2:
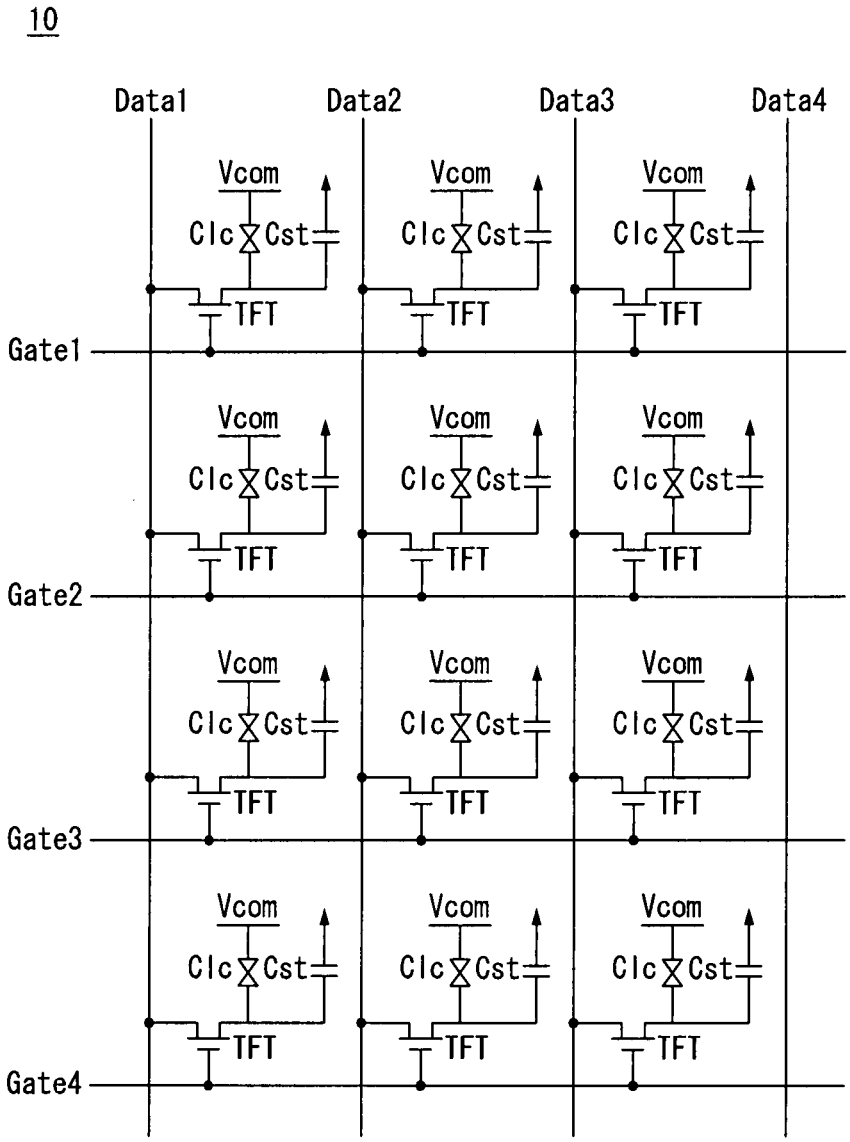
FIG. 2 is an equivalent circuit diagram of the pixel array of the LCD panel shown in FIG. 1.

Referring to FIGS. 1 and 2, a liquid crystal display (LCD) device includes a LCD panel 10, a source driver 12 for driving data lines 14 of the LCD panel 10, a gate driver 13 for driving gate lines 15 of the LCD panel 10, a timing controller 11 for controlling the source driver 12 and the gate driver 13, a backlight for providing light to the LCD panel 10, a scanning backlight controller 23 for controlling sequential driving of light sources 21 of the backlight, and light source drivers 22.

The LCD panel 10 has a liquid crystal layer between two sheets of glass substrates. The data lines 14 and the gate lines 15 cross each other on a lower substrate of the LCD panel 10. A matrix of liquid crystal cells Clc are arranged in the LCD panel 10 with the data lines 14 and the gate lines 15 crossing each other and form a pixel array as illustrated in FIG. 2. The pixel array includes the data lines 14, the gate lines 15, thin film transistors (TFTs), the pixel electrodes of the liquid crystal cells Clc electrically coupled to the respective TFTs, and storage capacitors Cst.

A black matrix, a color filter and a common electrode are typically formed on a upper substrate of the LCD panel 10. The common electrode is formed on the upper substrate in LCD devices that utilize a vertical electric field, such as a twisted nematic (TN) mode and a vertical alignment (VA) mode. On the other hand, the common electrode is formed on the lower substrate together with the pixel electrodes in LCD devices that utilize a horizontal electric field, such as an in-plane switching (IPS) mode and a fringe field switching (FFS) mode. A polarization plate is attached to each of the upper and lower glass substrates of the LCD panel 10. An orientation film for setting the pretilt angle of liquid crystal is formed on inner surfaces of the glass substrates that come into contact with the liquid crystal layer.

The source driver 12 includes a number of source drive ICs. The source driver 12 latches digital video data R'G'B' under the control of the timing controller 11. The source driver 12 converts the digital video data R'G'B' into positive-polarity/negative-polarity analog data voltages using positive-polarity/negative-polarity gamma compensation voltages and supplies them to the data lines 14.

The gate driver 13 includes a number of gate drive ICs. The gate driver 13 is provided with a shift register, a level shifter for converting an output signal of the shift register into a signal having a swing width suitable for driving the TFTs of the liquid crystal cells, an output buffer, etc. The gate driver 13 sequentially outputs gate pulses or scan pulses having a pulse width of about one horizontal period to the gate lines 15.

The timing controller 11 receives digital video data RGB and timing signals Vsync, Hsync, DE and DCLK from an external system board. The timing signals include the vertical sync signal Vsync, the horizontal sync signal Hsync, the data enable signal DE and the dot clock signal DCLK. The timing controller 11 generates timing control signals DDC and GDC based on the timing signals Vsync, Hsync, DE and DCLK to control timings of the source driver 12 and the gate driver 13. The timing controller 11 supplies the video data RGB to the scanning backlight controller 23 and also supplies to the source driver 12 the video data R'G'B' modulated by the scanning backlight controller 23. The timing controller 11 is capable of inserting an interpolation frame between the frames of the video data received at a frame frequency of 60 Hz, multiplying the source timing control signal DDC and the gate timing control signal GDC, and controlling the operations of the source driver 12 and the gate driver 13 at a frame frequency of 60×N Hz (where N is a positive integer equal to or greater than 2).

The backlight may be either a direct type or an edge type. The backlight illustrated in FIG. 1 is an edge-type backlight, but it should be appreciated that any type of backlight can be used in the present invention. The edge-type backlight has a structure in which the light sources 21 are arranged on a side of a light guide plate 20 and a number of optical sheets are arranged between the LCD panel 10 and the light guide plate 20. Typically, the optical sheets include one or more prism sheets and one or more diffusion sheets. The optical sheets may also include a dual brightness enhancement film (DBEF). The direct-type backlight has a structure in which a number of optical sheets are stacked under the LCD panel 10 and a number of the light sources 21 are arranged under the optical sheets. The light sources 21 may be implemented using one or more of a cold cathode fluorescent lamp (CCFL), an external electrode fluorescent lamp (EEFL) and a light emitting diode (LED). The optical sheets diffuse light incident on the light guide plate 20 or the diffusion sheets and direct the light to a surface of the LCD panel 10 at a substantially vertical angle.

The scanning backlight controller 23 controls the light sources 21 in a pulse width modulation (PWM) manner under the control of the timing controller 11 so that the light sources 21 are sequentially driven in the data scanning direction of the LCD panel 10. To do so, the scanning backlight controller 23 analyzes the input video data RGB, controls the duty ratio of a PWM signal according to results of the analysis, and adjusts a driving current of the light sources 21 by controlling the light source drivers 22. In addition, the scanning backlight controller 23 modulates the input video data RGB in order to compensate for a variation in the brightness or luminance of the backlight caused by the driving current of the light sources 21 and supplies the modulated video data R'G'B' to the timing controller 11. It should be appreciated that the scanning backlight controller 23 may be embedded in the timing controller 11 in accordance with the principles of the present invention.

Figure 3:
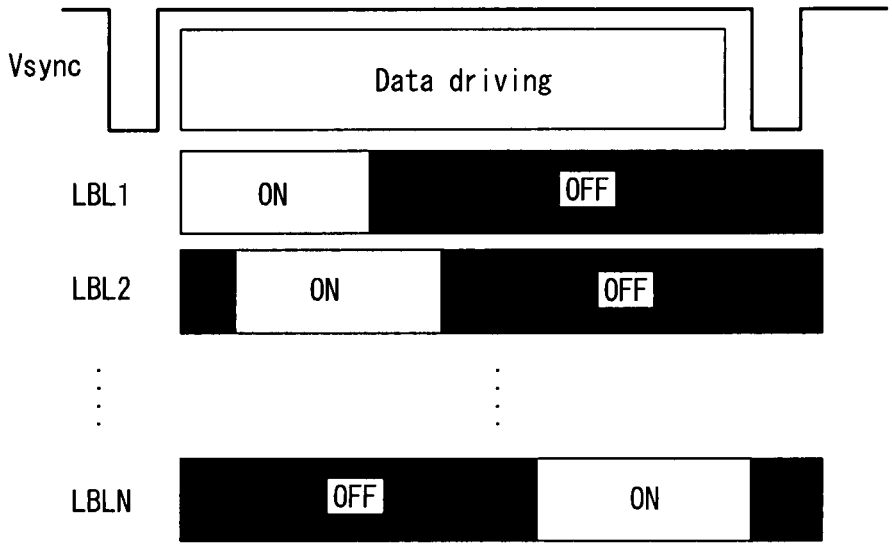
FIG. 3 is a timing diagram illustrating a scanning backlight driving according to an embodiment of the present invention.

The light source drivers 22 sequentially drive the respective light sources 21 under the control of the scanning backlight controller 23, as illustrated in FIG. 3. The light sources 21 are synchronized with the data scanning of the LCD panel 10. In FIG. 3, symbols 'LBL1 to LBLN' denote the light sources 21. In addition, a symbol 'ON' denotes the turn-on time of the light sources 21 during one frame interval, and a symbol 'OFF' denotes the turn-off time of the light sources 21 during one frame interval. The turn-on and turn-off times ON/OFF of the light sources 21 are determined according to the PWM signal from the scanning backlight controller 23. The turn-on time ON of the light sources 21 becomes longer when the duty ratio of the PWM signal approaches 100% and becomes shorter when the duty ratio of the PWM signal becomes lower. In other words, the turn-on time ON of the light sources 21 is in a proportional relationship with the duty ratio of the PWM signal. The light source drivers 22 also control a driving current of the light sources 21 in response to the duty ratio of the PWM signal under the control of the scanning backlight controller 23.

Figure 4:
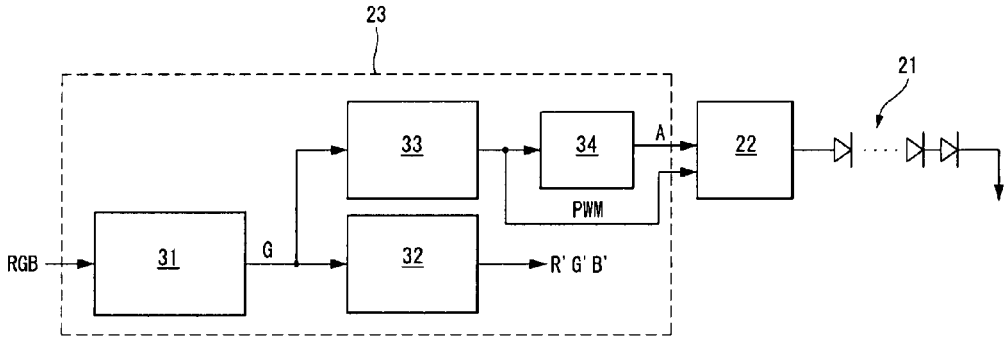
FIG. 4 is a circuit diagram of the scanning backlight controller shown in FIG. 1.
Figure 5:
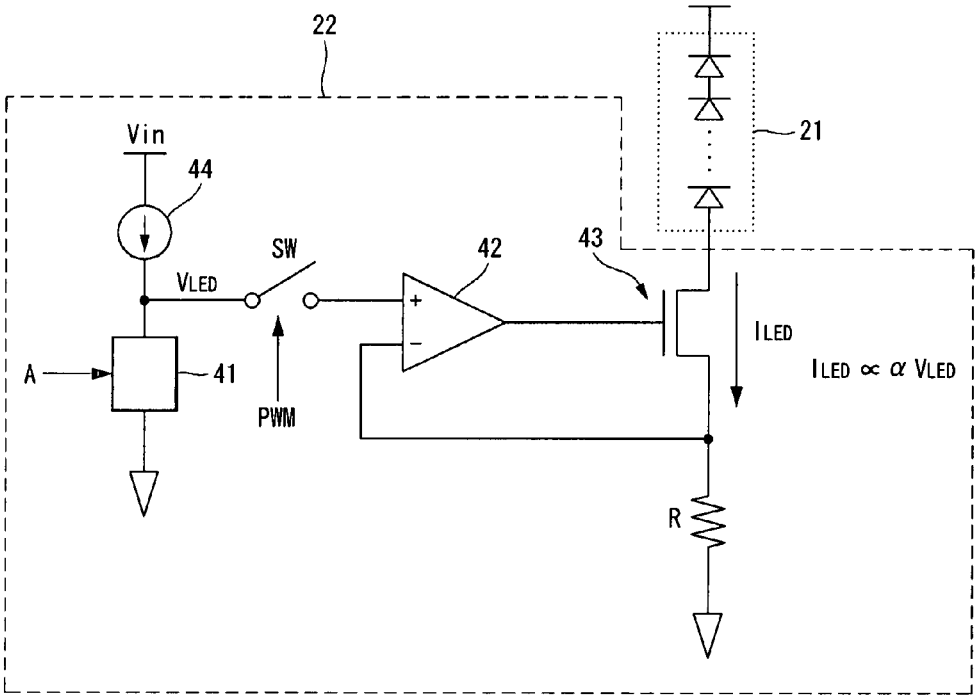
FIG. 5 is a circuit diagram of the light source driver shown in FIGS. 1 and 4.

FIGS. 4 and 5 are circuit diagrams of the scanning backlight controller 23 and the light source drivers 22.

Referring to FIG. 4, the scanning backlight controller 23 includes an input image analysis unit 31, a data modulation unit 32, a duty generation unit 33 and a current control unit 34. The input image analysis unit 31 performs a histogram analysis (e.g., an accumulated distribution function) of video data RGB of input images and calculates a frame-representative value of the accumulated distribution function, such as a mean value or the highest frequency value. The input image analysis unit 31 determines a gain value G based on the frame-representative value and supplies the gain value G to the data modulation unit 32 and the duty generation unit 33. The gain value G may be a higher value with the frame-representative value increasing and may be a lower value with the frame-representative value decreasing.

The data modulation unit 32 receives the gain value G from the input image analysis unit 31 and modulates the video data RGB input to the LCD panel 10 by, for example, expanding a dynamic range of the video data RGB. An upward modulation width of the data may increase as the gain value G from the input image analysis unit 31 increases, and a downward modulation width of the data may decrease as the gain value G decreases. The modulated video data R'G'B' is controlled according to the driving current of the light source 21 so that the brightness or luminance of the LCD device does not change abruptly. The data modulation in the data modulation unit 32 may be implemented using a look-up table.

The duty generation unit 33 determines the duty ratio of the PWM signal based on the gain value G from the input image analysis unit 31. The duty ratio (%) of the PWM signal is determined in proportion to the gain value G.

The current control unit 34 outputs a current control signal A which varies in response to the duty ratio of the PWM signal from the duty generation unit 33. The current control signal A may be an analog signal or a digital signal.

Figure 6:
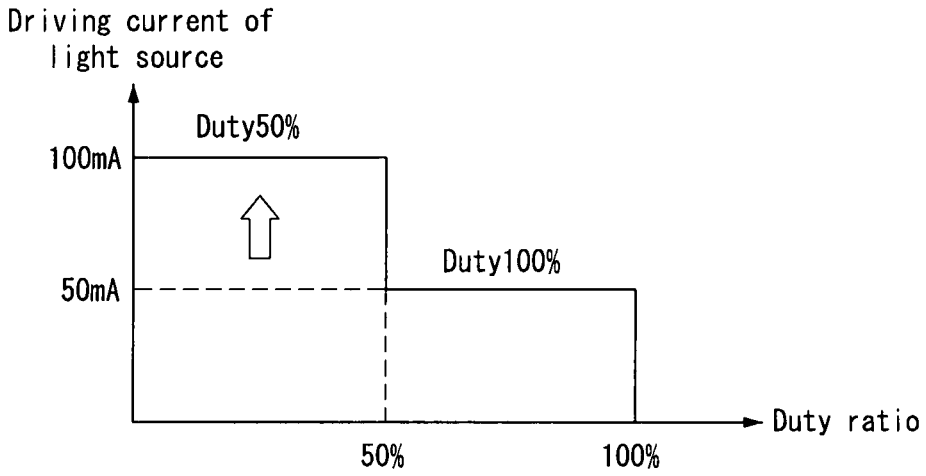
FIGS. 6 and 7 are graphs showing a change in the driving current of a light source according to the duty ratio of a pulse width modulation (PWM) signal.
Figure 7:
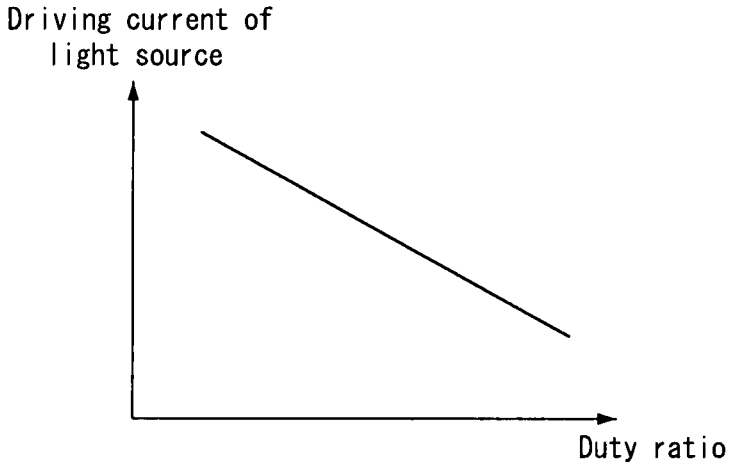

The light source driver 22 includes a static current source 44, an input voltage controller 41, a switch element SW, an operational amplifier 42 and a transistor 43. The static current source 44 receives an input voltage (Vin) and generates a constant light source driving voltage ($V_{LED}$). The input voltage controller 41 is electrically coupled between the output terminal of the static current source 44 and a ground voltage source. The input voltage controller 41 controls a discharge amount of the light source driving voltage ($V_{LED}$) in response to the current control signal A. The input voltage controller 41 controls the light source driving voltage ($V_{LED}$) in an inverse proportion to the duty ratio of the PWM signal, as shown in FIGS. 6 and 7. The input voltage controller 41 may control the light source driving voltage ($V_{LED}$) using a transistor electrically coupled between the static current source 44 and the ground voltage source or a variable resistor circuit.

The light source driving voltage ($V_{LED}$) is supplied to the non-inverting input terminal of the operational amplifier 42 in response to the PWM signal through the switch element SW. The non-inverting input terminal of the operational amplifier 42 is electrically coupled to the output terminal of the switch element SW, and the inverting input terminal of the operational amplifier 42 is electrically coupled to the drain terminal of the transistor 43. The output terminal of the operational amplifier 42 is electrically coupled to the gate terminal of the transistor 43. The operational amplifier 42 controls a gate terminal voltage of the transistor 43 according to a feedback voltage from the drain terminal of the transistor 43.

The transistor 43 controls a driving current of the light source 21 under the control of the operational amplifier 42. When the light source 21 is implemented with an LED, the source terminal of the transistor 43 is electrically coupled to the anode electrode of the LED. A driving current ($I_{LED}$) of the light source 21 is controlled in proportion to the light source driving voltage ($V_{LED}$) that is controlled by the input voltage controller 41 and is also controlled in inverse proportion to the duty ratio of the PWM signal in accordance with Equation 1:

$$I_{LED}=n\times 1/D \quad \text{(Equation 1)}$$

wherein 'D' indicates the duty ratio (%) of the PWM signal, and 'n' is a constant.

As illustrated in FIGS. 6 and 7, the driving current ($I_{LED}$) of the light sources 21 increases as the turn-off time OFF of the light sources 21 increases during the driving of scanning backlight. For example, when the duty ratio of the PWM signal is 100%, the driving current ($I_{LED}$) of the light sources is controlled to be 50 mA. When the duty ratio of the PWM signal is reduced to 50% with the turn-off time OFF of the light sources 21 being lengthened, the driving current ($I_{LED}$) of the light sources 21 is increased to 100 mA.

As described above, a driving current of the light sources increases as the turn-off time OFF of the light sources 21 are lengthened during a scanning backlight of an LCD device. As a result, a reduction in brightness or luminance of the LCD device caused by the scanning backlight is minimized, and an effective impulsive driving can be obtained.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD) device, comprising:

a liquid crystal display panel;

a plurality of backlight sources configured to provide light to the liquid crystal display panel;

a scanning backlight controller configured to generate a pulse width modulation (PWM) signal for controlling a turn-on time and a turn-off time of the light sources and a current control signal for controlling a driving current of the backlight light sources; and a plurality of light source drivers configured to turn on and off the backlight sources in response to the PWM signal and control the driving current of the backlight sources in response to the current control signal, wherein each of the light source drivers includes:

a static current source configured to generate a light source driving voltage;

an input voltage controller receiving the current control signal that is generated from the scanning backlight controller and varies according to a duty ratio of the PWM signal, configured to control a discharge amount of the light source driving voltage in response to the current control signal such that the driving current of the light source is inversely proportional to the duty ratio of the PWM signal and be electrically coupled between the output terminal of the static current source and a ground voltage source;

a switch element configured to supply the light source driving voltage to a non-inverting input terminal of an operational amplifier in response to the PWM signal; and a transistor configured to control the driving current in response to the voltage supplied to a gate terminal, wherein the gate terminal of the transistor is coupled to an output terminal of the operational amplifier, a source terminal thereof is coupled to the backlight sources and a drain terminal thereof is coupled to an inverting input terminal of the operational amplifier.

2. The LCD device according to claim 1, wherein the plurality of backlight sources are scanned in the same direction as a data scanning direction.

3. The LCD device according to claim 1, wherein the scanning backlight controller includes:

an input image analysis unit configured to calculate a frame-representative value by performing a histogram analysis of an input video signal, and determine a gain value based on the frame-representative value;

a data modulation unit configured to modulate the input video signal based on the frame-representative value;

a duty generation unit configured to determine a duty ratio of the PWM signal based on the gain value.

4. The LCD device according to claim 3, wherein the scanning backlight controller is embedded in a timing controller.

5. The LCD device according to claim 3, wherein the data modulation unit includes a lookup table to modulate the input video signal.

6. The LCD device according to claim 1, wherein the switch element is controlled in response to the PWM signal.

7. The LCD device according to claim 1, wherein the backlight sources are a light emitting diode (LED) and an anode of the LED is electrically coupled to an output terminal of the operational amplifier.

8. A scanning backlight driving method for a liquid crystal display (LCD) device, comprising:

generating a pulse width modulation (PWM) signal to control a turn-on time of a backlight source based on a result of the analyzing an input video signal and a current control signal that varies according to a duty ratio of the PWM signal; and adjusting a driving current of the backlight source in an inverse proportion to the duty ratio of the PWM signal, wherein the adjusting a driving current of the backlight source includes:

generating a light source driving voltage based on the current control signal that varies according to the duty ratio of the PWM signal;

controlling a discharge amount of the light source driving voltage in response to the current control signal;

controlling to supply the light source driving voltage to a non-inverting input terminal of an operational amplifier in response to the PWM signal; and supplying the voltage to a gate terminal of a transistor, wherein the gate terminal of the transistor is coupled to an output terminal of the operational amplifier, a source terminal thereof is coupled to the backlight sources and a drain terminal thereof is coupled to an inverting input terminal of the operational amplifier.

9. The driving method according to claim 8, wherein the turn-on time of the backlight source is in a proportional relationship with the duty ratio of the PWM signal.

10. The driving method according to claim 9, wherein the generating a pulse width modulation (PWM) signal includes:

calculating a frame-representative value by performing a histogram analysis of an input video signal;

determining a gain value based on the frame-representative value;

determining the duty ratio of the PWM signal based on the gain value; and outputting the current control signal which varies in response to the duty ratio of the PWM signal.

11. The driving method according to claim 10, wherein the input video signal is modulated using a lookup table.

12. The driving method according to claim 8, wherein the LCD device includes a plurality of backlight sources of which driving current is adjusted in an inverse proportion of the duty ratio of the PWM signal, and further comprising scanning the plurality of backlight sources in the same direction as a data scanning direction.

* * * * *